United States Patent [19]

Belica

[11] Patent Number: 4,766,343

[45] Date of Patent: Aug. 23, 1988

[54] STATIC CONVERGENCE ASSEMBLY

[76] Inventor: Roddy Belica, 1221 N. Humphrey Ave., Oak Park, Ill. 60302

[21] Appl. No.: 795,280

[22] Filed: Nov. 5, 1985

[51] Int. Cl.[4] ..... H01J 29/54; H01J 29/76

[52] U.S. Cl. ..... 313/412; 313/433; 335/212

[58] Field of Search ..... 313/412, 425, 432, 433, 313/439, 440; 315/368; 335/212

[56] References Cited

U.S. PATENT DOCUMENTS

| | | | |
|---|---|---|---|
| 3,138,730 | 6/1964 | Heuer et al. | 335/212 |
| 3,349,268 | 10/1967 | Babcock et al. | 335/212 |
| 3,354,337 | 11/1967 | De Both | 335/212 X |
| 3,512,035 | 5/1970 | Egawa et al. | 313/412 X |

*Primary Examiner*—David K. Moore

*Assistant Examiner*—Sandra L. O'Shea

*Attorney, Agent, or Firm*—Lockwood, Alex, FitzGibbon & Cummings

[57] ABSTRACT

A static convergence assembly includes a collar adapted to encircle the neck of a cathode ray tube (CRT). A number of extensions project radially outwardly from the collar along selected radii of the CRT neck and individually carry elongate stems mounted for longitudinal and rotational movement therealong. A permanent magnet, carried at the end of each stem nearest the CRT neck, develops a beam deflecting magnetic field within the CRT. The rotational and longitudinal position of each stem can be adjusted to adjust the orientation and strength of each magnetic field to alter the deflection of each beam as required to achieve static convergence.

27 Claims, 2 Drawing Sheets

FIG. 1
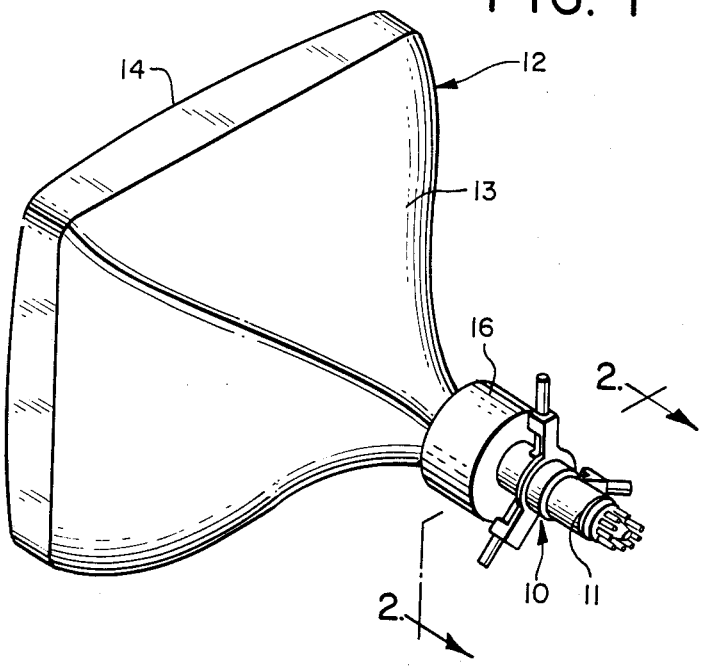
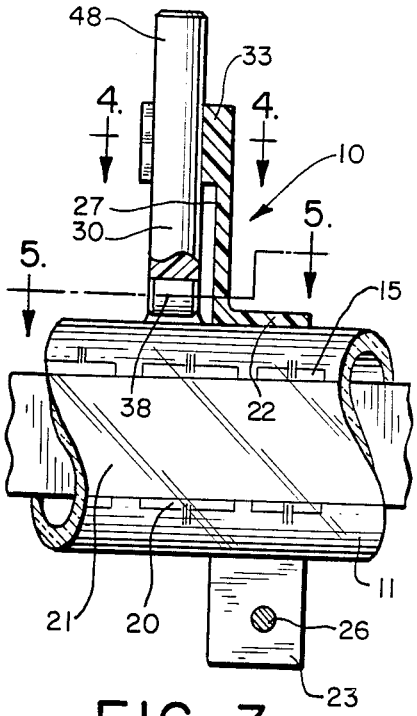
FIG. 3
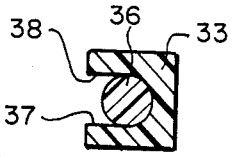
FIG. 4
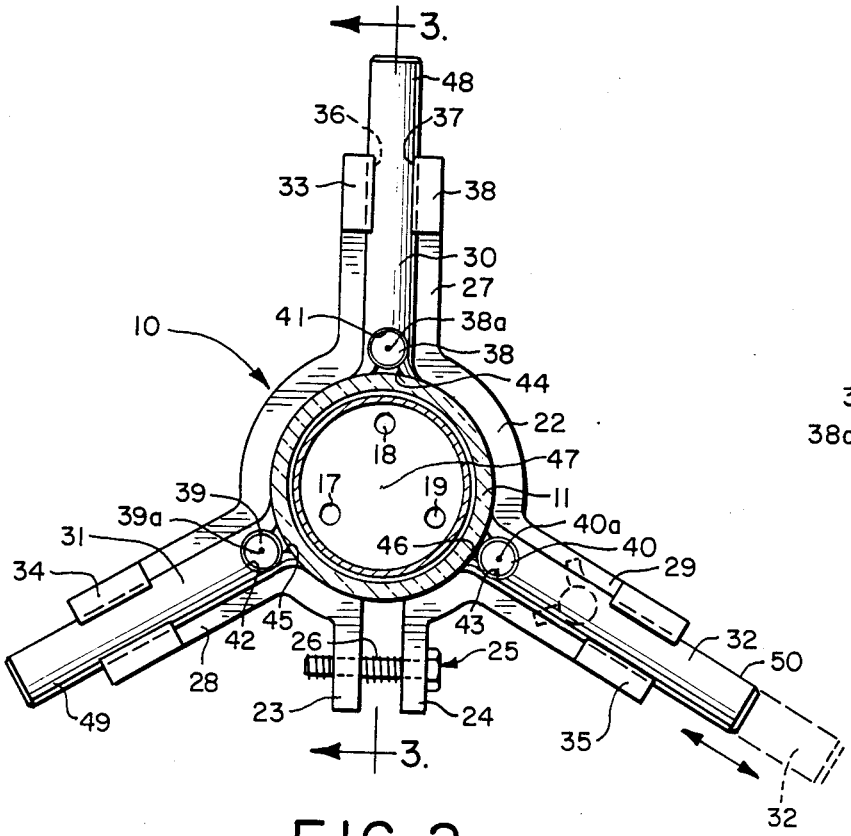
FIG. 2
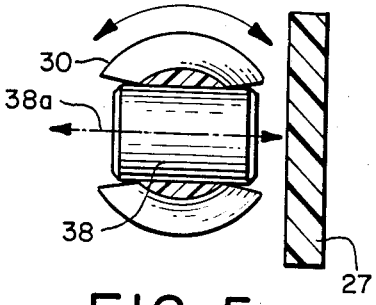
FIG. 5

STATIC CONVERGENCE ASSEMBLY

BACKGROUND OF THE INVENTION

This invention relates generally to static convergence assemblies for cathode ray tubes (CRTs) and particularly to a static convergence assembly wherein a plurality of magnetic elements are maintained in fixed angular orientation relative to one another and are independently adjustable with regard to distance from, and orientation with respect to, the neck of a CRT.

In color television receivers, color images are produced on the screen of a CRT through the combined use of three independent electron beams and an array of red, green and blue phosphor dots on the screen surface. Color images of various hues are produced through controlled independent illumination of the primary color phosphor dots. To this end, color CRTs include a shadow mask which functions to assure that individual phosphor dots will be illuminated only by those electrons which arrive from a particular direction. Since the paths of the three electron beams generated within the tube are different from one another, the CRT, when properly constructed and adjusted, can be operated such that each beam illuminates only those phosphor dots of a particular color. When each of the beams is modulated with appropriate information, a wide spectrum of perceived colors can be displayed.

To generate the three electron beams, color CRTs are typically provided with three electron guns arranged in either a straight "in-line" or triangular "delta" pattern. Regardless of the pattern employed, proper operation of the CRT results when the three electron beams are made to converge toward a single point on the shadow mask. To provide such convergence, a variety of devices have been developed which seek to provide independent control of the static position of each electron beam.

In one prior convergence device, a plurality of generally circular rings, carrying a number of magnetic pole pairs, were disposed around the neck of the CRT. The rings were grouped into pairs which could be independently rotated around the CRT neck in unison or in opposition to one another. Although this convergence device was effective in operation, it was difficult to construct and adjust and, therefore, had a detrimental effect on manufacturing econony.

In another prior convergence device, a number of parallel, straight, ferrite rods, each having a plurality of pole pairs formed thereon, were mounted in tangential orientation relative to the neck of a CRT. Each of the rods was adjustable with respect to its axial and rotational position such that beam convergence could be readily achieved. Although this convergence device was considerably simpler in both operation and construction than earlier devices, it nevertheless retained some complexity and thus offered room for still further improvement.

In view of the foregoing, it is an object of the present invention to provide a new and improved CRT static convergence assembly.

It is a further object of the present invention to provide a CRT static convergence assembly which is simple and economical to manufacture and adjust, and which provides effective adjustment of beam convergence.

It is still another object of the present invention to provide a CRT static convergence assembly which is adaptable for use with both "in-line" and "delta" electron gun configurations.

SUMMARY OF THE INVENTION

A static convergency assembly for use with cathode ray tubes (CRTs) of the type having an elongate neck of generally circular cross-section includes a magnet for developing a magnetic field. The magnet includes a pair of spaced magnetic poles between which a pole axis is defined. A mount is provided for positioning the magnet adjacent the neck of the CRT such that the pole axis is oriented generally perpendicularly to a selected radius extending radially therefrom. The mounting is such that the magnet is rotatable around the selected radius and is adjustably positionable therealong. When so mounted, the strength and orientation of the magnetic field developed within the CRT neck by the magnet, can be adjusted.

BRIEF DESCRIPTION OF THE DRAWINGS

The features of the present invention which are believed to be novel are set forth with particularity in the apended claims. The invention, together with the further objects and advantages thereof, may best be understood by reference to the following description taken in conjunction with the accompanying drawings, in the several figures of which like reference numerals identify like elements, and in which:

FIG. 1 is an oblique rear perspective view of a static convergence assembly, constructed in accordance with the invention, mounted on the neck of a CRT;

FIG. 2 is a cross-sectional view of the static convergence assembly shown in FIG. 1 taken along line 2—2 thereof;

FIG. 3 is a cross-sectional view of the static convergence assembly shown in FIG. 2 taken along line 3—3 thereof;

FIG. 4 is a cross-sectional view of the static convergence assembly shown in FIG. 3 taken along line 4—4 thereof;

FIG. 5 is a cross-sectional view of the static convergence assembly shown in FIG. 3 taken along line 5—5 thereof;

DESCRIPTION OF THE PREFERRED EMBODIMENT

Figure 6:
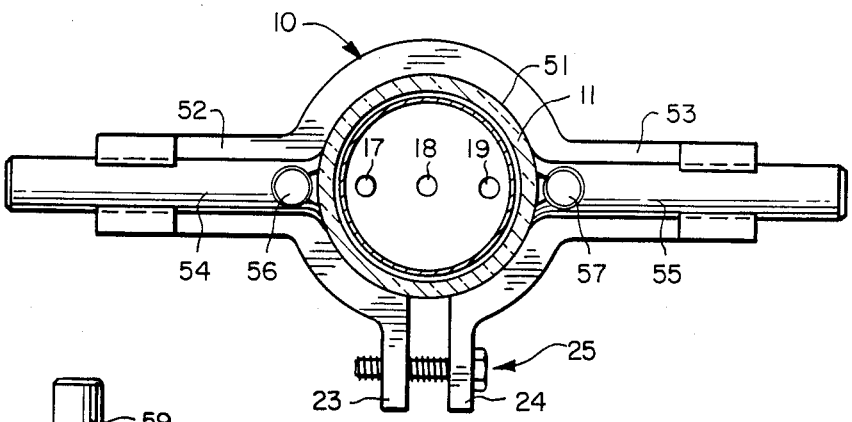
FIG. 6 is a front elevational view of an alternate embodiment of the static convergence assembly, constructed in accordance with the invention, suitable for use with CRTs having an "in-line" electron gun configuration.

Referring to the drawings, and in particular to FIGS. 1, 2 and 3, a static convergence assembly 10 is shown mounted on the elongate neck 11 of a conventional television cathode ray tube (CRT) 12. In accordance with conventional design, CRT 12 includes a hollow glass envelope 13 which tapers from a generally planar viewing screen 14 toward neck 11. Color images are formed on viewing screen 14 by means of three electron beams which are generated by an electron gun assembly 15 (FIG. 3) located within neck 11. A deflection yoke 16 encircles a portion of the CRT neck and functions, in known manner, to magnetically deflect the electron beams horizontally and vertically across viewing screen 14 to produce a display raster.

Red, green and blue phosphor dots are distributed over the interior surface of the viewing screen, and a shadow mask (not shown), positioned adjacent the phosphor coating, functions to assure that individual phosphor dots are illuminated by only one of the three electron beams generated by electron gun 15. Proper color balance in the displayed image is achieved when phosphor dots of a particular hue are illuminated by only one of the three electron beams. This is achieved when the three beams converge such that each strikes the shadow mask at the same point at all times during the raster scan. Static convergence assembly 10 functions to magnetically deflect each electron beam such that the desired convergence is obtained.

As illustrated in FIGS. 2 and 3, CRT neck 11 is of generally circular hollow cross-section. Electron gun assembly 15 includes three individual electron guns 17, 18 and 19 which are arranged in a triangular or "delta" pattern and which generate the electron beams for illuminating the blue, green and red phosphor dots respectively. A plurality of accelerating electrodes 20 and 21 are positioned immediately ahead of electron gun assembly 15 and function to shape and modulate each of the electron beams with appropriate video information. Static convergence assembly 10 is positioned on CRT neck 11 between electron gun assembly 15 and viewing screen 14 as shown.

Static convergence assembly 10 is preferably molded of an electrically insulating, nonmagnetic, semi-flexible material, such as nylon, and includes a collar portion 22 adapted to encircle a portion of the generally circular exterior of neck 11. Collar 22 extends substantially fully around the neck and terminates in a pair of outwardly extending, substantially parallel, spaced flanges 23 and 24 through which a threaded fastner, such as sheet metal screw 25, extends. The threaded shank 26 of screw 25 extends through a first aperture in flange 24 and engages a second aperture formed in flange 23. Preferably, the first aperture is somewhat larger than the second such that only flange 23 threadedly engages shank 26. Upon rotation of screw 25, flanges 23 and 24 are drawn closer together to lock the static convergence assembly in place.

Static convergence assembly 10 further includes a plurality of extension arms which extend radially outwardly from collar 22. In the case of static convergence assemblies intended for use with CRTs having a "delta" electron gun configuration, three extenstion arms 27, 28 and 29 are provided at equal 120° spacing from one another as shown in FIGS. 1 and 2. As further shown in FIGS. 2, 3 and 5, each of the extension arms is generally rectangular in shape and cross-section, and is integrally formed with collar 22.

Static convergence assembly 10 further includes a plurality of elongate stems 30, 31 and 32 extending along extension arms 27, 28 and 29 in generally parallel alignment therewith. As illustrated, each of the stems is of generally circular cross-section and is longer than the extension arm along which it is positioned. Preferably, the stems are formed of the same material as the collar.

Adjacent the outermost end of each extension arm, a generally cube-shaped block 33, 34 and 35 is formed. A circular passage 36 is formed through each block and extends in a direction parallel to, and spaced from, the longitudinal axis of the associated extension arm. A channel 37 is formed through the side face 38 of each block such that the block is of somewhat U-shaped cross-section as illustrated in FIG. 4. The dimensions of bore 36 and channel 37 are such that stems 30–32 are snugly received in their respective blocks with the result that each can be moved to, and retained in, a selected rotational and longitudinal position relative to its adjacent extension arm. As shown, for example, by the arrow and phantom view of stem 32 in FIG. 2, each stem is longitudinally displaceable over a range along its associated extension arm.

In accordance with one aspect of the invention, the innermost end of each stem 30–32 is provided with a magnetic field producing element such as permanent magnets 38, 39 and 40. Each magnet is of generally cylindrical form and has a length substantially equal to the diameter of the stem on which it is mounted. A pair of magnetic poles are formed at opposite ends of each magnet and a pole axis **38*a*, 39*a* and 40*a* is defined between each pole pair. Each magnet is mounted such that its pole axis is oriented perpendicularly to the longitudinal axis of its associated stem, and is received in a circular recess 41, 42 or 43 formed therethrough. A bevelled channel 44, 45 and 46 is formed in the end of each stem and extends into the adjacent recess as illustrated to allow each permanent magnet to be pressed through the end of the stem and into its recess. The bevelled shape of channels 44–46 permits the magnets to be installed at the time of manufacture through the simple expedient of pressing the stems downwardly onto the magnets such that each magnet is forced into its respective recess. As shown in FIG. 2, the ends of each stem preferably extend slightly beyond the magnets and are shaped to conform to the external shape of CRT neck 11**.

In use, static convergence assembly 10 is positioned on CRT neck 11 such that each of the extension arms extends along a radius defined by the central axis 47 of the neck and one of the electron guns 17–19. Screw 25 is then tightened to lock the assembly in the desired position. Next, the rotational and longitudinal position of each stem 30–32 is adjusted by displacing the stems along the directions shown by the arrows in FIGS. 2 and 5. This has the effect of altering the strength and orientation of the magnetic fields developed within CRT neck 11 by each of the permanent magnets with the further effect that the paths of the electron beams developed by electron guns 17–19 are varied. Because each permanent magnet is substantially closer to one of the three electron beams than to the others, adjustment of a single stem will primarily influence the position of the nearest beam. Accordingly, static convergence assembly 10 provides substantially independent adjustment of each of the three electron beams and thereby simplifies the convergence adjustment. To further enhance the ease of adjustment, the length of each stem is such that a convenient handle portion 48–50 projects beyond the ends of the extension arms even when each stem is pressed fully toward CRT neck 11.

FIG. 6 illustrates the static convergence assembly adapted for use with CRTs having an "in-line" electron gun configuration. As shown, the electron guns 17, 18 and 19 of such a CRT are arranged in linear fashion along a diameter of CRT neck 11. The static convergence assembly includes a collar 51 having a pair of extension arms 52 and 53 extending radially outwardly therefrom at 180° spacing from one another. Collar 51 and extension arms 52 and 53 are similar in construction to their counterparts in the "delta" configuration embodiment shown in FIG. 2. A pair of stems 54 and 55 are mounted along arms 52 and 53 in the manner previously described and carry permanent magnets 56 and 57 at their ends adjacent CRT neck 11.

In use, collar 51 is positioned such that arms 52 and 53 are aligned with the electron guns 17–19 as shown. When so positioned, permanent magnets 56 and 57 function to magnetically deflect the electron beams, formed by electron guns 17 and 19 respectively, toward the beam developed by the center electron gun 18. In most cases, the adjustment available with the assembly shown in FIG. 6 will be sufficient to achieve satisfactory beam convergence.

Figure 7:
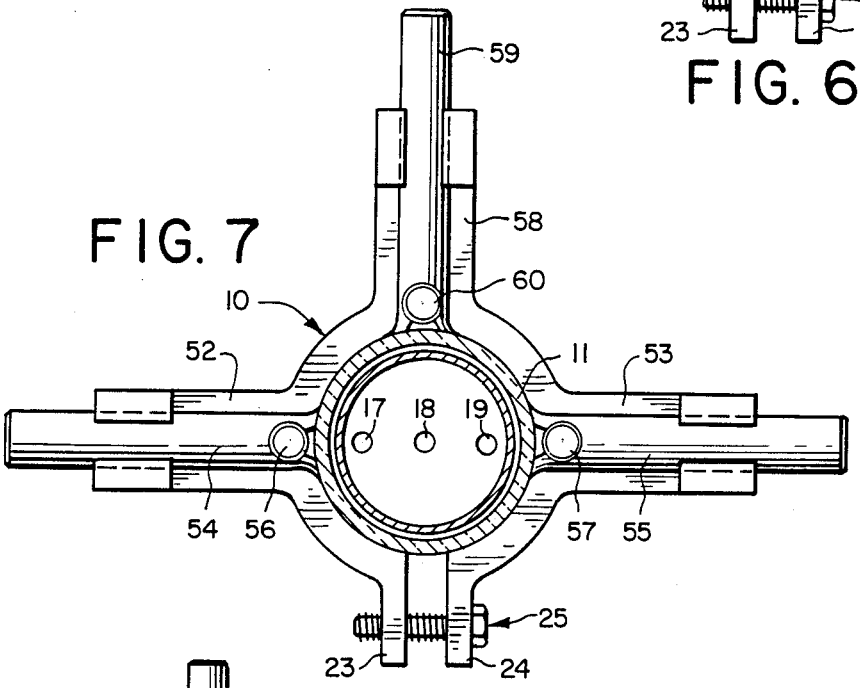
FIG. 7 is another alternate embodiment of the static convergence assembly suitable for use with CRTs having an "in-line" electron gun configuration showing the addition of a third converging magnet.

In the event a further degree of adjustment is required, the static convergence assembly illustrated in FIG. 7 can be utilized. In this configuration, a third extension arm 58 is provided opposite screw 25 and at an equal 90° circumferential spacing from arms 52 and 53. A stem 59, which can be identical with the other stems shown and described, extends along extension arm 58 and carries a permanent magnet 60 at its end nearest CRT neck 11. The field produced by magnet 60 primarily influences the vertical position of the beam developed by electron gun 18 and permits exact convergence to be achieved in the event of slight miss alignment of the electron guns. The construction of the assembly illustrated in FIG. 7 is all other respects similar to that shown in FIG. 2.

Figure 8:
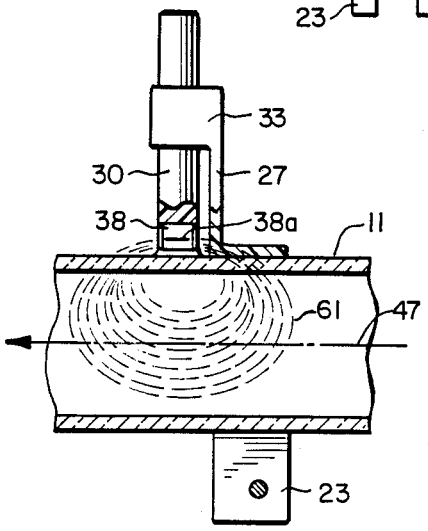
FIG. 8 is a side elevational view, partially in section, of the static convergence assembly shown in FIG. 7 showing the magnetic field orientation which results when a convergence magnet is positioned parallel to the axis of the CRT neck.
Figure 10:
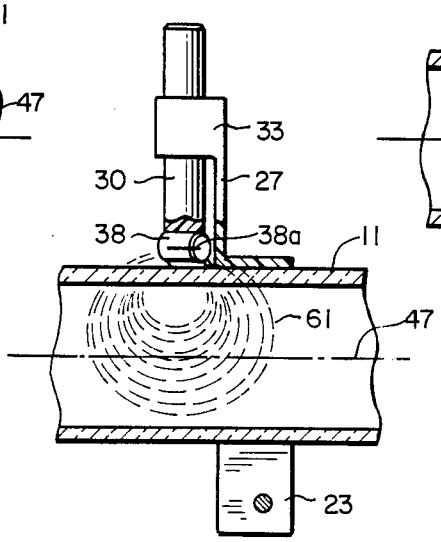
FIG. 10 is a view similar to FIGS. 8 and 9 showing the magnetic field orientation resulting when the convergence magnet shown therein is oriented obliquely to the axis of the CRT neck
Figure 9:
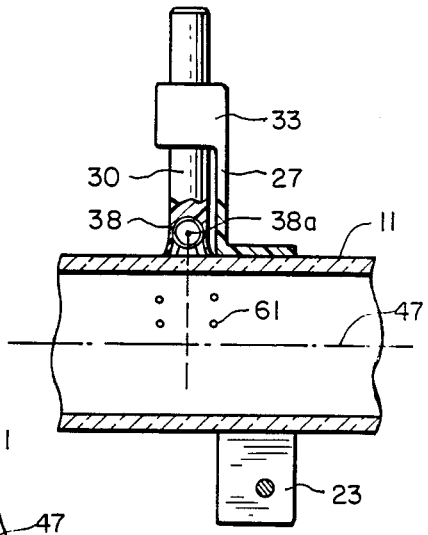
FIG. 9 is a view similar to FIG. 8 showing the magnetic field orientation which results when the convergence magnet shown therein is oriented perpendicularly to axis of the CRT neck.

FIGS. 8, 9 and 10 show the magnet field orientations which result when one of the stems (e.g. stem 30) is rotated. In FIG. 8, the pole axis 38*a* of permanent magnet 38 is parallel to the axis 47 of CRT neck 11. Accordingly, the lines of force 61 of the field produced by the magnet are substantially parallel to the path traveled by the electrons in each of the electron beams It is a well known physical property that movement of a charged particle in a direction parallel to the field lines of a static magnetic field will have no effect on the movement of the particle. Accordingly, when the magnet is positioned as shown in FIG. 8, the field it develops will have little or no effect on the position of the beam on the CRT viewing screen.

In FIG. 9, the magnet is positioned such that its pole axis 38*a* is oriented perpendicularly to the axis 47 of the CRT neck. When so positioned, the magnetic field lines will be substantially perpendicular to the path of the beam electrons and, accordingly, each electron will experience a substantially vertically oriented force as it passes through the magnetic field. This has the effect of deflecting the electron beam either up or down on the viewing screen depending on the particular orientation of the magnet. Rotation of the magnet through 180° will reverse the direction of beam deflection.

In FIG. 9, the pole axis 38*a* of the permanent magnet is oriented at an angle with respect to the axis of the CRT neck, and, thus, the magnetic field produced within the neck will include parallel and perpendicular components. Beam deflection will depend primarily on the strength of the perpendicular field component and will be substantially unaffected by the parallel components. The angular position of the permanent magnet with respect to the neck axis determines the relative strength of the perpendicular field component and thus affects the degree to which the beam is deflected. Accordingly, the degree of beam deflection can be varied through rotation of the appropriate stem. It will be appreciated that displacing the stem away from the CRT neck will reduce the effective magnetic field strength within the CRT neck and will also influence the degree of beam deflection. It will also be appreciated that the rotational position of the static convergence assembly itself on the CRT neck will influence the direction of beam deflection and can be adjusted, when necessary, so as to achieve optimum beam convergence.

Although a particular static convergence assembly construction has been shown and described, it will be appreciated that various modifications can be made thereto. For example, while cylindrical permanent magnets have been shown, rectangular or square magnets could be successfully employed. Furthermore, various means other than the flanges 23, 24 and screw 25 can be employed for mounting the convergence assembly to the CRT neck. Finally, the precise shapes of the various extension arms, collars and stems is not critical.

While a particular embodiment of the invention has been shown and described, it will be obvious to those skilled in the art that changes and modifications may be made without departing from the invention in its broader aspects, and, therefore, the aim in the apended claims is to cover all such changes and modifications as fall within the true spirit and scope of the invention.

I claim:

1. A cathode ray tube deflection system, comprising:

a cathode ray tube having an elongate neck and a screen for displaying a desired predetermined picture;

an electron gun assembly contained within said neck and.including an outer, an inner, and another outer electron gun;

said electron guns being arranged in a generally linear fashion along a diameter of said neck and providing, respectively, an outer, an inner, and another outer beam of electrons, said electron beams, when undeflected generally defining a plane across said neck;

first and second mounting means extending outwardly from said neck;

a first magnet carried by said first mounting means with the magnetic poles of said first magnet in magnetic communication with one of said outer electron beams, said magnetic poles defining a first magnetic axis;

a second magnet carried by said second mounting means with the magnetic poles of said second magnet in magnetic communication with one of said outer electron beams, said magnetic poles defining a second magnetic axis; and whereby with adjustment of said mounting means the angles between said first and second magnetic axes and said plane are adjustable to vary the deflection of said outer electron beams, both within and out of said plane, by said first and second magnets.

2. The cathode ray tube deflection system of claim 1, said system further comprising a collar portion releasably affixed around said elongate neck, said collar portion including two extension arms extending radially outwardly from said neck, said first and second mounting means being supported by said first and second extension arms, respectively, and each of said mounting means being longitudinally and rotationally adjustable relative to said extension arms.

3. The cathode ray tube deflection system of claim 2, wherein said extension arms are spaced 180° apart from one another around said elongate neck.

4. The cathode ray tube deflection system of claim 2, wherein each of said extension arms include a bore for receiving said mounting means therethrough whereby said mounting means is rotationally and longitudinally slidable relative to said extension arms.

5. The cathode ray tube deflection system of claims 2 or 4, wherein said mounting means each comprise an elongate stem, each said stem having a circular cross-section and having a longitudinal extent greater than said extension arms such that a user-actuable handle portion is formed beyond the outermost end of said extension arms.

6. The cathode ray tube deflection system of claim 2, wherein said magnets each comprise generally cylindrical permanent magnets, and each of said mounting means include a bore for receiving said magnets therein.

7. A cathode ray tube deflection system of claim 6, wherein each of said mounting means include a beveled channel opening into said bore whereby said magnets can be pressed through said channel and into said bore.

8. The cathode ray tube deflection system of claims 1 or 3, wherein said first and second mounting means lie substantially within said plane.

9. A cathode ray tube deflection system, comprising:

a cathode ray tube having an elongate neck and a screen for displaying a desired predetermined picture;

an electron gun assembly contained within said neck and including an outer, an inner, and another outer electron gun;

said electron guns being arranged in a generally linear fashion along a diameter of said neck and providing, respectively, an outer, an inner, and another outer beam of electrons, said electron beams, when undeflected generally defining a plane across said neck;

a collar portion releasably affixed to said neck and including two extension arms, said arms extending radially outwardly from said neck;

first and second elongate stems each said stem being adjustably held within each said extension arm, said elongate stems each being rotationally and longitudinally adjustable within each said extension arm;

a first magnet carried at an end of said first stem with the magnetic poles of said first magnet in magnetic communication with one of said outer electron beams, said magnetic poles defining a first magnetic axis;

a second magnet carried at an end of said second stem with the magnetic poles of said second magnet in magnetic communication with one of said outer electron beams, said magnetic poles defining a second magnetic axis; and whereby with adjustment of each of said stems the angle between said first and second magnetic axes and said plane are adjustable to vary the deflection of said outer electron beams, both within and out of said plane, by said first and second magnets.

10. The cathode ray tube deflection system of claim 9, wherein said extension arms each include a bore for receiving said elongate stems therethrough, said stems each being rotationally and longitudinally slidable relative to each said extension arm.

11. The cathod ray tube deflection system of claim 9, wherein said magnets each comprise generally cylindrical permanent magnets, and each of said stems include a bore adjacent said one end for receiving said magnets therein.

12. A cathode ray tube deflection system of claim 11, wherein one end of each of said stems include a beveled channel opening into said bore whereby said magnets can be pressed through said end into said bore.

13. The cathode ray tube delfection system of claim 9, wherein said first and second stems lie substantially within said plane.

14. In a cathode ray tube deflection system including a cathode ray tube having an elongate neck, an electron gun assembly contained within said neck and including three electron guns arranged in a generally linear fashion and providing an outer, an inner, and another outer beam of electrons which, when undeflected, generally define a plane, and a static convergence assembly, said convergence assembly comprising:

first and second mounting means extending outwardly from the neck;

a first magnet carried by said first mounting means with the magnetic poles of said first magnet in magnetic communication with one of the outer electron beams, said magnetic poles defining a first magnetic axis;

a second magnet carried by said second mounting means with the magnetic poles of said second magnet in magnetic communication with one of the outer electron beams, said magnetic poles defining a second magnetic axis; and whereby, the adjustment of said mounting means the angles between said first and second magnetic axes and the plane are adjustable to vary the deflection of the outer electron beams, both within and out of the plane, by said first and second magnets.

15. The static convergence assembly of claim 14, said assembly further comprising a collar portion releasably attachable to the elongate neck of the cathode ray tube, said collar portion including first and second extension arms extending radially outwardly form and affixed to said collar portion, said first and second mounting means being supported by said first and second extension arms, respectively, said mounting means being rotationally and longitudinally adjustable relative to said extension arms.

16. The static convergence assembly of claim 15, wherein said extension arms spaced 180° apart from one another around said elongate neck.

17. The static convergence assembly of claims 14 or 15, wherein said first and second mounting means lie substantially within the plane.

18. The cathode ray tube deflection system of claim 15, wherein each of said extension arms include a bore for receiving said mounting means therethrough whereby said mounting means are rotationally and longitudinally slidable relative to said extension arms.

19. The static convergence assembly of claims 15 or 18, wherein said mounting means each comprise an elongate stem, each said stem having a circular cross-section and having a longitudinal extent greater than said extension arms such that a user-actuable handle portion is formed beyond the outermost end of said extension arms.

20. The static convergence assembly of claim 14, wherein said magnets each comprise generally cylindrical permanent magnets, and said mounting means each include a bore for receiving said magnets therein.

21. The static convergence assembly of claim wherein 20, wherein each of said mounting means include a beveled channel opening into said bore whereby said magnets can be pressed through said channel and into said bore.

22. In a cathode ray tube deflection system including a cathode ray tube having an elongate neck, an electron gun assembly contained within said neck and including three electron guns arranged in a generally linear fashion and providing an outer, an inner, and another outer beam of electrons, which, when undeflected, generally define a plane, and a static convergence assembly, said convergence assembly comprising:

a collar portion releasably attachable to the elongate neck of the cathode ray tube;

first and second extension arms, each extending radially outwardly from and affixed to said collar, said extension arms spaced 180° apart from one another;

a first elongate stem positioned within said first extension arm, said first stem being rotationallly and longitudinally adjustable within said first extension arm;

a second elongate stem positioned within said second extension arm, said second stem being rotationally and longitudinally movable within said second extension arm;

a first magnet retained within an end of said first stem with the magnetic poles of said first magnet in magnetic communication with one of the outer electron beams, said magnetic poles defining a first magnetic axis;

a second magnet retained within an end of said second stem with the magnetic poles of said second magnet in magnetic communication with one of the outer electron beams, said magnetic poles defining a second magnetic axis; and whereby, with adjustment of each of said stems the angle between said first and second magnetic axes and the plane are adjustable to vary the deflection of the outer electron beams, both within and out of the plane, by said first and second magnets.

23. The static convergence assembly of claim 22, wherein said first and second stems lie substantially within the plane.

24. The cathode ray tube deflection system of claim 22, wherein said extension arms each include a bore for receiving said elongate stems therethrough, said stems each being roatationally and longitudinally slidable relative to each said extension arm.

25. The cathode ray tube deflection system of claim 22, wherein each said stem is longer than each said extension arm such that a user-actuable handle portion is formed beyond the outermost end of each said extension arm.

26. The static convergence assembly of claim 22, wherein said magnets each comprise generally cylindrical permanent magnetic, and each of said stems include a bore adjacent said one end for receiving said magnets therein.

27. The static convergence assembly of claim 26, wherein each of said stems include a beverled channel opening into said bore whereby said magnets can be pressed through said channel and into said bore.

* * * * *